US012389976B2

(12) United States Patent
Berrian et al.

(10) Patent No.: US 12,389,976 B2
(45) **Date of Patent: *Aug. 19, 2025**

(54) ARTICLE OF FOOTWEAR HAVING A KNITTED COMPONENT WITH A FOREFOOT PORTION AND A HEEL PORTION

(71) Applicant: NIKE, Inc., Beaverton, OR (US)

(72) Inventors: Travis J. Berrian, Portland, OR (US); Rory S. Blanche, Portland, OR (US); Weibing Gong, Portland, OR (US); John S. MacGilbert, Tigard, OR (US)

(73) Assignee: NIKE, Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/612,680

(22) Filed: Mar. 21, 2024

(65) Prior Publication Data

US 2024/0225168 A1 Jul. 11, 2024

Related U.S. Application Data

(62) Division of application No. 17/488,902, filed on Sep. 29, 2021, now Pat. No. 11,957,201, which is a (Continued)

(51) Int. Cl.
*A43B 1/04* (2022.01)
*A43B 3/10* (2006.01)
(Continued)

(52) U.S. Cl.
CPC ..... *A43B 1/04* (2013.01); *A43B 3/106* (2013.01); *A43B 23/0215* (2013.01);
(Continued)

(58) Field of Classification Search
CPC ..... A43B 1/04; A43B 23/0245; A43B 23/25; A43B 23/088
See application file for complete search history.

(56) References Cited

U.S. PATENT DOCUMENTS 3,681,860 A 8/1972 Bidegain
8,959,800 B2 * 2/2015 Sokolowski ..... A43B 23/02 36/89

(Continued)

FOREIGN PATENT DOCUMENTS

CN 202376726 U 8/2012
CN 103462310 A 12/2013

(Continued)

OTHER PUBLICATIONS

Separable: https ://www.merriam-webster.com/di ctionary /separable, 1 page.

*Primary Examiner* — Jillian K Pierorazio
(74) *Attorney, Agent, or Firm* — Shook, Hardy & Bacon L.L.P.

(57) ABSTRACT

In one aspect, the present disclosure provides a knitted component. The knitted component may have a forefoot portion with a top layer and a bottom layer, where a void is formed between the top layer and the bottom layer, and where the top layer is secured to the bottom layer via at least one common knit structure. A heel area may extend from the bottom layer of the forefoot portion in a longitudinal direction and may be secured to the bottom layer of the forefoot portion via at least one common knit structure. At least one extension may extend from the heel area in a second direction, the second direction being different than the longitudinal direction.

18 Claims, 6 Drawing Sheets

Related U.S. Application Data division of application No. 16/054,150, filed on Aug. 3, 2018, now Pat. No. 11,154,110.

(60) Provisional application No. 62/541,495, filed on Aug. 4, 2017.

(51) Int. Cl.

| | |
|---|---|
| ***A43B 23/02*** | (2006.01) |
| ***A43B 23/04*** | (2006.01) |
| ***A43B 23/08*** | (2006.01) |
| ***D04B 1/22*** | (2006.01) |
| *A43B 23/26* | (2006.01) |

(52) U.S. Cl.

CPC ..... *A43B 23/0245* (2013.01); *A43B 23/025* (2013.01); *A43B 23/0295* (2013.01); *A43B 23/042* (2013.01); *A43B 23/081* (2013.01); *D04B 1/22* (2013.01); *A43B 23/26* (2013.01); *D10B 2403/023* (2013.01); *D10B 2501/043* (2013.01)

(56) References Cited

U.S. PATENT DOCUMENTS

| | | | | |
|---|---|---|---|---|
| 8,973,410 | B1 * | 3/2015 | Podhajny | A43B 23/024 36/47 |
| 9,003,836 | B1 * | 4/2015 | Podhajny | A43B 23/0245 66/69 |
| 9,713,362 | B2 * | 7/2017 | Farris | A43B 13/41 |
| 9,907,349 | B2 * | 3/2018 | Huffman | A43B 1/04 |
| 2004/0244226 | A1 | 12/2004 | Farys et al. | |
| 2005/0115284 | A1 * | 6/2005 | Dua | A43B 9/00 66/178 R |
| 2006/0101667 | A1 * | 5/2006 | Kane | A43B 3/106 36/7.1 R |
| 2008/0110048 | A1 * | 5/2008 | Dua | A43B 3/0031 12/146 C |
| 2008/0110049 | A1 * | 5/2008 | Sokolowski | A43B 23/0235 36/50.1 |
| 2012/0240429 | A1 * | 9/2012 | Sokolowski | D04B 1/22 36/50.1 |
| 2012/0255201 | A1 * | 10/2012 | Little | A43B 23/042 12/142 R |
| 2014/0137433 | A1 * | 5/2014 | Craig | A43B 23/0205 66/170 |
| 2014/0237861 | A1 | 8/2014 | Podhajny | |
| 2014/0245633 | A1 * | 9/2014 | Podhajny | D04B 1/123 66/170 |
| 2014/0245637 | A1 * | 9/2014 | Fahmi | A43B 23/0235 36/84 |
| 2014/0259760 | A1 | 9/2014 | Dojan et al. | |
| 2014/0352173 | A1 * | 12/2014 | Bell | A43B 23/0245 28/165 |
| 2014/0352179 | A1 * | 12/2014 | Bell | A43B 23/024 66/170 |
| 2014/0360049 | A1 | 12/2014 | Panian et al. | |
| 2015/0320136 | A1 * | 11/2015 | Dua | D02G 3/36 66/170 |
| 2015/0342284 | A1 * | 12/2015 | Huffman | A43B 1/04 66/170 |
| 2015/0342285 | A1 * | 12/2015 | Huffman | A43B 23/025 66/170 |
| 2016/0198798 | A1 * | 7/2016 | Ikenaka | A43B 23/0205 66/170 |
| 2016/0213097 | A1 * | 7/2016 | Uchikawa | A43B 23/0245 |
| 2016/0286898 | A1 * | 10/2016 | Manz | A43B 23/0255 |
| 2017/0049187 | A1 * | 2/2017 | Aristizabal | D04B 1/108 |
| 2017/0188661 | A1 * | 7/2017 | Lee | A43B 5/002 |
| 2018/0199668 | A1 * | 7/2018 | Yumiba | D04B 7/04 |
| 2018/0255863 | A1 * | 9/2018 | Kuo | A43B 23/042 |
| 2018/0343974 | A1 * | 12/2018 | Hancock | D04B 1/108 |
| 2019/0037959 | A1 | 2/2019 | Berrian et al. | |

FOREIGN PATENT DOCUMENTS

| | | | |
|---|---|---|---|
| CN | 204444428 | U | 7/2015 |
| CN | 105283090 | A | 1/2016 |
| CN | 105578917 | A | 5/2016 |
| CN | 106235496 | A | 12/2016 |

* cited by examiner

ARTICLE OF FOOTWEAR HAVING A KNITTED COMPONENT WITH A FOREFOOT PORTION AND A HEEL PORTION

CROSS REFERENCE TO RELATED APPLICATIONS

This application is a divisional of U.S. Non-Provisional application Ser. No. 17/488,902 entitled "Article of Footwear Having a Knitted Component with a Forefoot Portion and a Heel Portion" and filed on Sep. 29, 2021, issued as U.S. Pat. No. 11,957,201, which is a divisional of Ser. No. 16/054,150, entitled "Article of Footwear Having a Knitted Component with a Forefoot Portion and a Heel Portion" and filed on Aug. 3, 2018, issued as U.S. Pat. No. 11,154,110, which claims the benefit of U.S. Provisional Application No. 62/541,495, entitled "Article of Footwear Having a Knitted Component with a Forefoot Portion and a Heel Portion" and filed on Aug. 4, 2017, the entirety of both are hereby incorporated by reference.

BACKGROUND

Conventional articles of footwear generally include two primary elements: an upper and a sole structure. The upper is generally secured to the sole structure and may form a void within the article of footwear for comfortably and securely receiving a foot. The sole structure is generally secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and may form a ground-engaging portion of the sole structure that is formed from a durable and wear-resistant material.

The upper of the article of footwear generally extends over the instep and toe areas of the foot, along the medial and lateral sides of the foot, and around the heel area of the foot and in some instances under the foot. Access to the void in the interior of the upper is generally provided by an ankle opening in and/or adjacent to a heel region of the footwear. A lacing system is often incorporated into the upper to adjust the fit of the upper, thereby facilitating entry and removal of the foot from the void within the upper. In addition, the upper may include a tongue that extends under the lacing system to enhance adjustability of the footwear, and the upper may incorporate other structures such as, for example, a heel counter to provide support and limit movement of the heel.

BRIEF DESCRIPTION OF THE DRAWINGS

The embodiments of the present disclosure may be better understood with reference to the following drawings and description. The components in the figures are not necessarily to scale, with emphasis instead being placed upon illustrating the principles of the present disclosure.

Moreover, in the figures, like referenced numerals designate corresponding parts throughout the different views and arrangements.

DETAILED DESCRIPTION OF THE INVENTION

Figure 1:
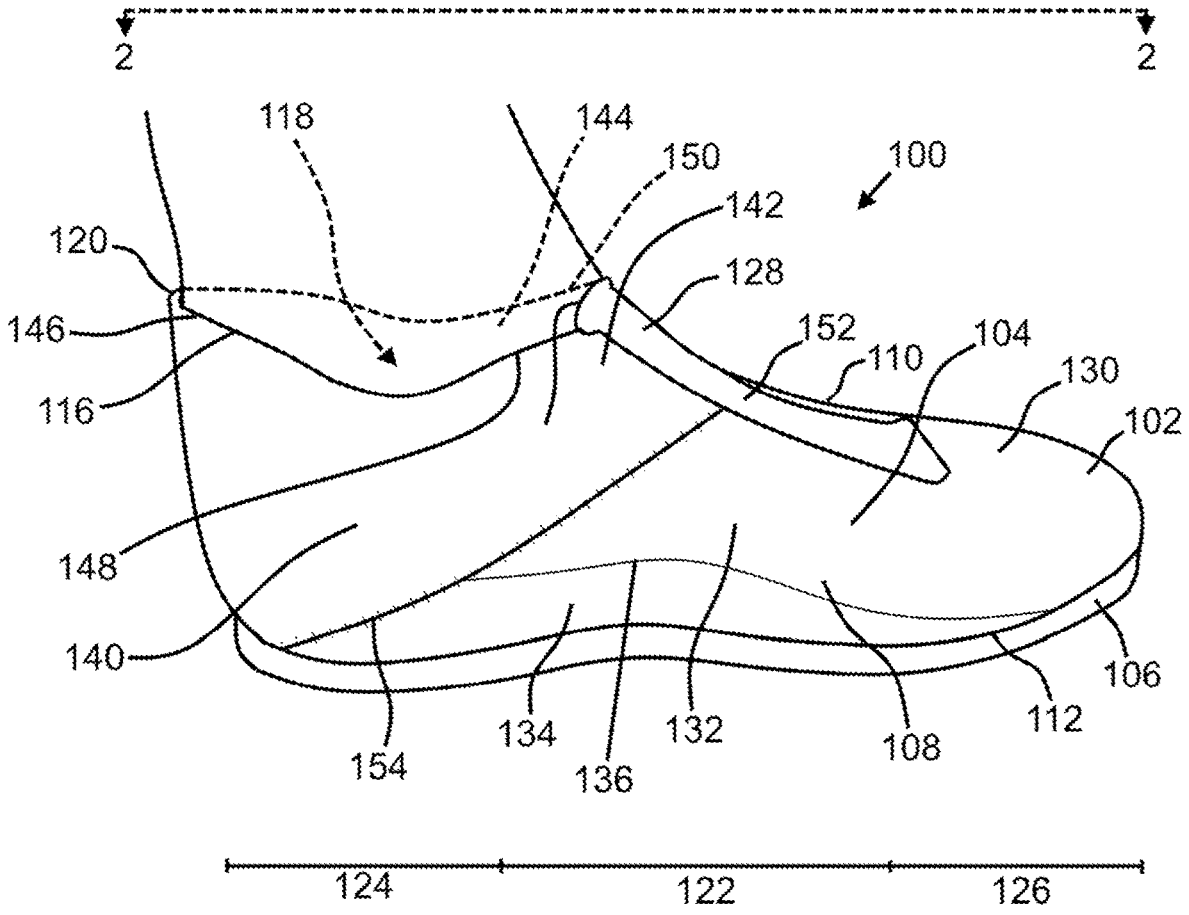
FIG. 1 is an illustration showing an article of footwear with a knitted component in accordance with certain aspects of the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Certain aspects of the present disclosure relate to uppers configured for use in an article of footwear and/or other articles, such as articles of apparel. When referring to articles of footwear, the disclosure may describe basketball shoes, running shoes, biking shoes, cross-training shoes, football shoes, golf shoes, hiking shoes and boots, ski and snowboarding boots, soccer shoes, tennis shoes, and/or walking shoes, as well as footwear styles generally considered non-athletic, including but not limited to dress shoes, loafers, and sandals.

In one aspect, the present disclosure provides a knitted component. The knitted component may have a forefoot portion with a top layer and a bottom layer, where a void is formed between the top layer and the bottom layer, and where the top layer is secured to the bottom layer via at least one common knit structure. A heel area may extend from the bottom layer of the forefoot portion in a longitudinal direction and may be secured to the bottom layer of the forefoot portion via at least one common knit structure. At least one extension may extend from the heel area in a second direction, the second direction being different than the longitudinal direction.

In another aspect, the present disclosure provides an article of footwear. The article of footwear may include a forefoot portion having a top layer and a bottom layer, where a void is formed between the top layer and the bottom layer. A heel area may be secured to the bottom layer of the forefoot portion, and the heel area may form a first portion of a collar. At least one extension may extend from the heel area, where the at least one extension is secured to an edge of the top layer of the forefoot portion, and where the extension forms at least a second portion of the collar.

In another aspect, the present disclosure provides a method. The method may include forming a forefoot portion of a knitted component on a knitting machine, the forefoot portion having a top layer and a bottom layer, where a void is formed between the top layer and the bottom layer, and where the top layer is secured to the bottom layer via at least one common knit structure. The method may further include forming a heel area of the knitted component on the knitting machine, the heel area being secured to the bottom layer of the forefoot portion via at least one common knit structure. The method may further include forming at least one extension of the knitted component on the knitting machine, the at least one extension being attached to the heel area, and securing to the extension to an edge of the top layer of the forefoot portion.

In another aspect, the present disclosure provides an article of footwear with a knitted component, the knitted component having a heel area. The heel area may include a medial side, a lateral side, and a rear portion between the medial side and the lateral side, where at least one of the medial side and the lateral side of the knitted component includes a concave area on an outer surface of the knitted component.

In another aspect, the present disclosure provides an article of footwear with a knitted component, the knitted component having a heel area. The heel area may include a medial side, a lateral side, and a rear portion between the medial side and the lateral side, where at least one of the medial side and the lateral side of the knitted component includes a convex area on an inner surface of the knitted component, the inner surface defining a void.

FIG. 1 is an illustration showing an article of footwear 100 in accordance with certain aspects of this disclosure. Referring to FIG. 1, the article of footwear 100 may include an upper 102. Optionally, the upper 102 may be substantially formed as a textile component. The textile component may be any suitable type of textile, and in some embodiments it may be formed as a knitted component 104. As shown, the upper 102 may be secured to a sole structure 106. The upper 102 may include a lateral side 108 and a medial side 110. The area where the sole structure 106 joins the upper 102 may be referred to as a biteline 112. The upper 102 may be joined to the sole structure 106 in a fixed manner using any suitable technique, such as through the use of an adhesive, by sewing, etc. The upper 102 may extend partially or completely around a foot of a wearer and/or may be integral with the sole structure 106, and a sockliner may or may not be used. In some embodiments, the sole structure 106 may include a midsole and an outsole.

The upper 102 may additionally include a throat area 114 extending from an ankle opening 116 leading to the void 118, and a collar 120 may at least partially surround the ankle opening 116. The void 118 of the article of footwear 100 may be configured (e.g., sized and shaped) to receive and accommodate a foot of a person. The throat area 114 may be generally disposed in a midfoot area 122 of the upper 102. The midfoot area 122 of the upper 102 may be located between a heel area 124 and a toe area 126. In some embodiments, a tongue 128 may be disposed at least partially in the throat area 114. If the tongue 128 is included, the tongue 128 may be any type of tongue, such as a gusseted tongue or a burrito tongue. If a tongue 128 is not included, the lateral and medial sides of the throat area 114 may be joined together.

While the upper 102 is described herein as being formed primarily of the knitted component 104, a knitted component is optional, and it alternatively or additionally could include a textile component formed by a process other than knitting (e.g., weaving) and may also include other materials including, but not limited to, leather, plastics, rubbers, and any other materials. Forming the upper 102 with the knitted component 104 may provide the upper 102 with advantageous characteristics including, but not limited to, a particular degree of elasticity (for example, as expressed in terms of Young's modulus), breathability, bendability, strength, moisture absorption, weight, abrasion resistance, and/or a combination thereof. These characteristics may be accomplished by selecting a particular single layer or multi-layer knit structure (e.g., a ribbed knit structure, a single jersey knit structure, or a double jersey knit structure), by varying the size and tension of the knit structure, by using one or more yarns formed of a particular material (e.g., a polyester material, a relatively inelastic material, or a relatively elastic material such as spandex), by selecting yarns of a particular size (e.g., denier), and/or a combination thereof. The knitted component 104 may also provide desirable aesthetic characteristics by incorporating yarns having different colors, textures or other visual properties arranged in a particular pattern.

Further, the yarns themselves and/or the knit structure of the knitted component 104 may be varied at different locations such that the knitted component 104 has two or more portions with different properties (e.g., a portion forming the throat area 114 of the upper 102 may be relatively elastic while another portion may be relatively inelastic). Additionally or alternatively, in some embodiments, the knitted component 104 may incorporate one or more materials with properties that change in response to a stimulus (e.g., temperature, moisture, electrical current, magnetic field, or light). For example, the knitted component 104 may include yarns formed of one or more thermoplastic polymer materials (including material composites) that transition from a solid state to a softened or liquid state when subjected to certain temperatures at or above the melting point and then transitions back to a solid state when cooled. The thermoplastic polymer material(s) may provide the ability to heat and then cool a portion of the knitted component 104 to thereby form an area of bonded or continuous material (herein referred to as a "fused area") that exhibits certain advantageous properties including a relatively high degree of rigidity, strength, and water resistance, for example. Non-limiting examples of thermoplastic polymer materials are polyurethanes, polyamides, polyolefins, and/or certain nylons.

The knitted component 104 of the article of footwear 100 may include a forefoot portion 130 having a top layer 132 and a bottom layer 134, and the void 118 may be formed between the top layer 132 and the bottom layer 134. Thus, in the forefoot portion 130, the bottom layer 134 may form an underfoot portion associated with a plantar aspect of the foot (also known as the sole or bottom of the foot), and the top layer 132 may form an overfoot portion associated with the dorsal surface of the foot (also known as the foot's top surface). The bottom layer 134 may extend just above, and/or be secured to, the sole structure 106. In some embodiments, the top layer 132 and the bottom layer 134 may meet at the biteline 112, but that is optional, and they meet at a boundary 136 above the biteline 112 in FIG. 1.

The knitted component may additionally include a heel portion 140. A bottom side of the heel portion 140 may be secured to the sole structure 106. As described in more detail below, the heel portion 140 may be secured to the bottom layer 134 of the forefoot portion 130 via a common knit structure, and a first extension 142 and/or second extension 144 may extend from the heel portion 140 and secure to the top layer 132 of the forefoot portion 130 (e.g., via stitching).

The heel portion 140 may form a first collar portion 146 of the collar 120, and the first extension 142 and second extension 144 may form a respective second collar portion 148 and third collar portion 150 of the collar 120 on medial and lateral sides of the first collar portion 146.

In some embodiments, the first extension 142 and/or the second extension 144 may extend from the heel area 124 towards the throat area 114, and in some embodiments may extend to a location adjacent to the throat 152. A seam 154 may secure the first extension 142 to the forefoot portion 130, and specifically the top layer 132 of the forefoot portion 130. Optionally, the seam 154 may extend from adjacent to the throat to approximately the biteline 112, but other seam orientations/locations are also contemplated. As described in more detail below, the seam 154 may be formed after the knitted component is formed on a knitting machine.

Figure 2:
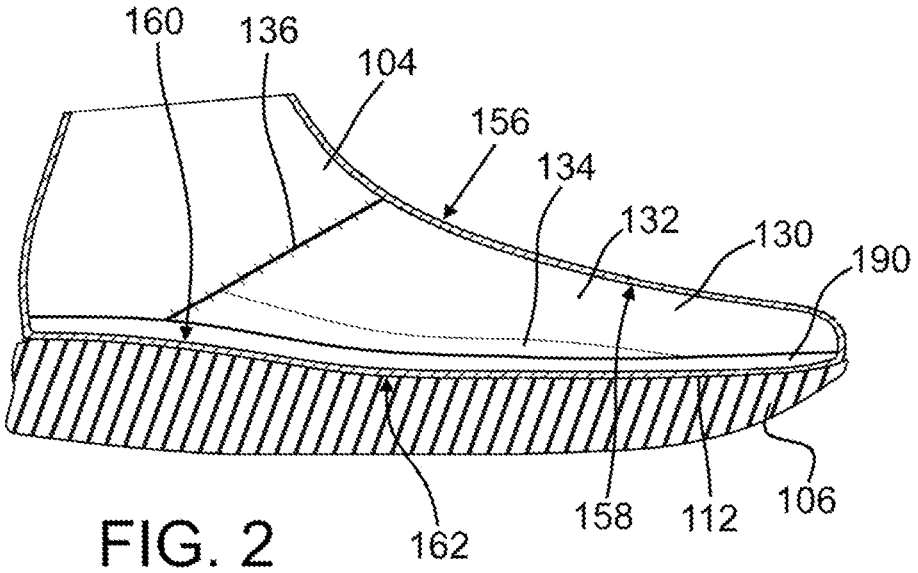
FIG. 2 is an illustration showing a side cutout view about line 2-2 of FIG. 1.

FIG. 2 shows a side cutout view of the article of footwear 100 about line 2-2 of FIG. 1. As shown in FIG. 2, the knitted component 104 may include the forefoot portion 130 having at least two separable layers: a top layer 132 and a bottom layer 134. The top layer 132 and the bottom layer 134 may have distinct, opposite-facing surfaces. For example, a first surface 156 of the top layer 132 may form an outer surface of the article of footwear 100 and a second surface 158 of the top layer 132 may face the void 118. With respect to the bottom layer 134, a third surface 160 may face the void 118 and a fourth surface 162 may face the sole structure 106 (shown in FIG. 1).

The void 118 may be formed between the top layer 132 and the bottom layer 134. The top layer 132 and the bottom layer 134 may be formed together on a knitting machine, and may converge at a boundary 136 (e.g., at a sewn seam as described in more detail below). The attachment at the boundary 136 may be provided by a common knit structure, such as a common course, loop, wale, and/or yarn extending between the top layer 132 and the bottom layer 134, and the common knit structure may be formed on the knitting machine when the top layer 132 and the bottom layer 134 are formed. Other attachment devices and/or methods are also contemplated (e.g., the top layer 132 and the bottom layer 134 may be sewn together after the knitting process, secured via an adhesive, etc.).

Figure 3:
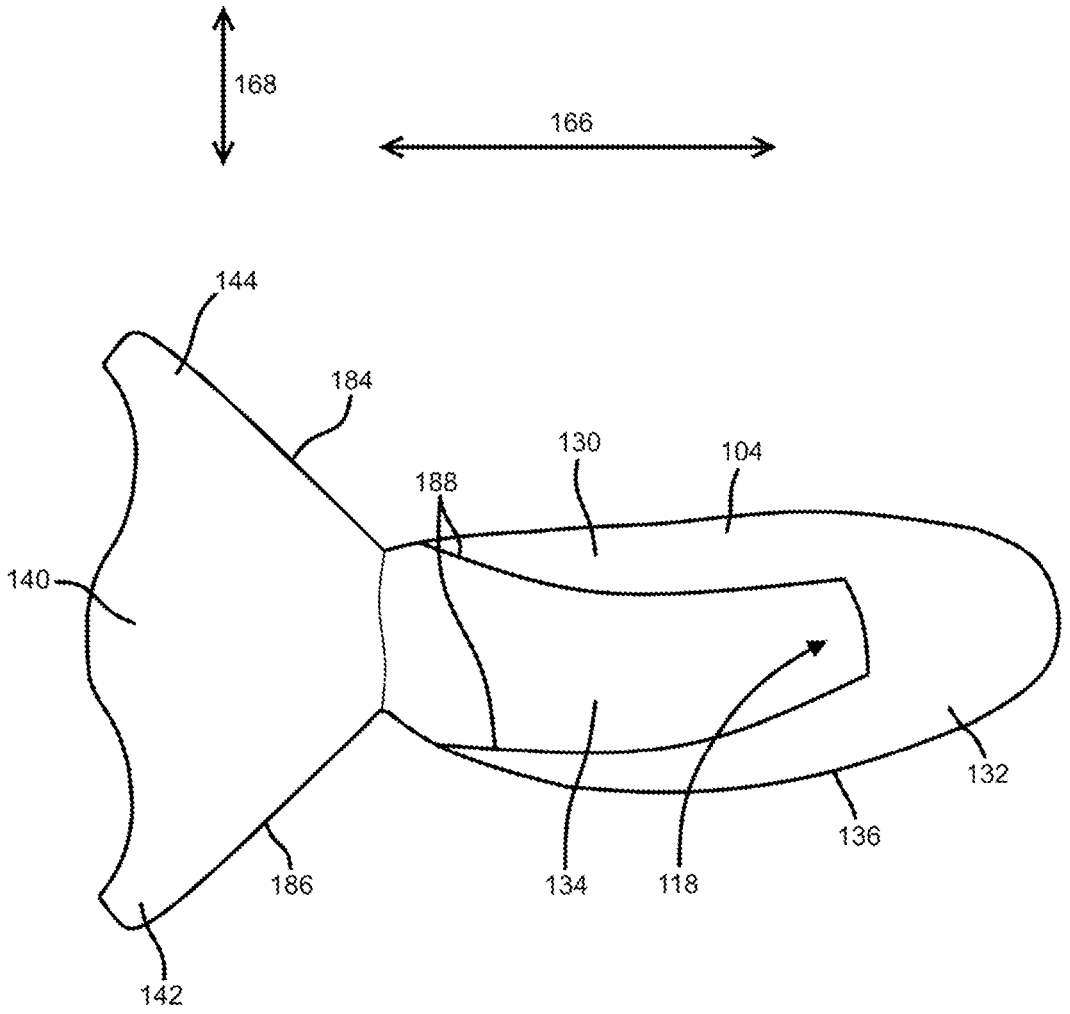
FIG. 3 is an illustration showing a knitted component for the article of footwear as it may appear after a knitting process in accordance with certain aspects of the present disclosure.

FIG. 3 shows the knitted component 104 as it may appear after knitting (e.g., on a flat knitting machine), but in an unfolded state before being lasted or otherwise manipulated into a wearable shape in the depicted article of footwear 100 of FIGS. 1-2. To form the multi-layer knitted component 104, the top layer 132 may primarily be formed on a front needle bed of a knitting machine and the bottom layer 134 may primarily be formed on a back needle bed (or vice versa), and the boundary 136 may be formed where knit structures cross between the front and back needle beds. If the top layer 132 and the bottom layer 134 are separable and define a pocket (void 118) therebetween, the layer formed on the front needle bed and/or the layer formed on the back needle bed may have a single jersey knit incorporating needles from only one bed.

Other knitting techniques may be additionally or alternatively used to form a multi-layer structure. For example, it is contemplated that both layers could utilize needles from each bed during the knitting process to enhance the ability to integrate functional and/or visual features within each layer. For example, one or more consecutive courses of the top layer 132 may utilize needles from both needle beds to provide the top layer 132 with a particular multi-bed knit structure. Then, prior to or during knitting one or more courses of the bottom layer 134, all loops of the top layer 132 may be transferred to a first needle bed to free the needles on the second needle bed to form the bottom layer 134 (and to prevent the top layer 132 from binding to the bottom layer 134). The bottom layer 134 may then be knitted on the second bed alone or may utilize needles on both needle beds (particularly if the top layer 132 leaves some needles on the first needle bed unoccupied). If the bottom layer 134 is formed on both beds, once it is time to resume knitting courses of the top layer 132, all loops associated with the bottom layer 134 may be transferred to the second bed to free the first bed for again forming the top layer 132 (and to prevent the bottom layer 134 from binding with the top layer 132). This process may be repeated as necessary.

If necessary, when knitting the top layer 132 and/or the bottom layer 134, certain needles on each bed may be skipped by the top layer 132 and/or the bottom layer 134 to leave needles unoccupied for knitting the other layer. Thus, the top layer 132 and/or the bottom layer 134 may have a reduced gauge and/or stitch density when compared to a full gauge portion (e.g., such as the heel portion 140 as described in more detail below). In some embodiments, a gauge of the top layer 132 and/or the bottom layer 134 (defined by the ratio of the number of needles used to the total number of needles available) may be at least 25% less than a gauge of the heel portion 140, at least 50% less, or even less. In one non-limiting embodiment, the gauge of the top layer 132 and the bottom layer 134 is about 50% of the gauge of the heel portion 140.

Additionally or alternatively, the top layer 132 and the bottom layer 134 may include a yarn referred to as a "fusible yarn," which in this disclosure refers to a yarn having a thermoplastic polymer material with a melting point of less than 120° C. In one exemplary embodiment, the fusible yarn of the top layer 132 and the bottom layer 134 may be a yarn having a polyester yarn surrounded by a thermoplastic polymer material or composite with a melting point of less than 100° C. (e.g., approximately 60° C.). After the knitting process, the knitted component 104 can be heated and then cooled such that the thermoplastic polymer material fuses and rigidifies to provide sufficient structure (e.g., rigidity) to the top layer 132 and bottom layer 134, particularly when the gauge of the top layer 132 and/or the bottom layer 134 is relatively low. In some embodiments, a second yarn may be included in at least one of the top layer 132 and the bottom layer 134 that is not configured to melt or fuse when subjected to the above-described heat (e.g., where melting or decomposition points of the second yarn are higher than the highest processing temperature of the knitted component 104). The second yarn may be any type of yarn, such as a polyester yarn suitable for providing comfort-related characteristics and/or desirable visual characteristics. Further, it may be advantageous to use a relatively thin yarn such that the top layer 132 and/or the bottom layer 134 have a desirable net-like appearance (at least in low-gauge areas), which may be made possible by the inclusion of the above-described fusible yarn.

The heel portion 140 may extend from the bottom layer 134 of the forefoot portion 130 in a longitudinal direction 166. Thus, when the knitted component 104 is initially removed from the knitting machine, the heel portion 140 may be only indirectly attached to the top layer 132 through the bottom layer 134. The heel portion 140 may be secured to the bottom layer of the forefoot portion 130 via at least one common knit structure (e.g., at least one common connecting course).

The knitted component 104 may further include a first extension 142 and a second extension 144 that extend from the heel portion 140. The first extension 142 and the second extension 144 may extend at least partially in a second direction 168 from the heel portion 140 (at least if the knitted component 104 is forced into a flattened state), where the second direction 168 is different than the longitudinal direction 166. For example, the second direction 168 may be approximately perpendicular to the longitudinal direction 166 (e.g., within 30% with respect to true perpendicular, or less, such as within 15%). More specifically, the first extension 142 may extend in a lateral direction and the second extension 144 may extend in a medial direction (or vice versa) with respect to the foot when the knitted component 104 is incorporated into an article of footwear 100. The first extension 142 and the second extension 144 may be formed on the knitting machine with the remainder of the knitted component 104, and thus they may share a common knit structure with the heel portion 140. When the knitted component 104 is initially removed from the knitting machine, the first extension 142 and the second extension 144 may be indirectly secured to the bottom layer 134 by way of the heel portion 140, and indirectly secured to the top layer 132 by way of the heel portion 140 and the bottom layer 134.

When the knitted component 104 is generally knitted in the longitudinal direction 166, the heel portion 140 may be knitted substantially before or substantially after the formation of the top layer 132 and the bottom layer 134 of the forefoot portion 130. The same can be said of the first extension 142 and the second extension 144. Advantageously, this may provide the opportunity for the heel portion 140 and the extensions 142, 144 to utilize the full capacity of both needle beds of the knitting machine during its formation. Thus, the heel portion 140 and the extensions 142, 144 may be fully or primarily formed of a double jersey knit structure. Herein, a "double jersey knit structure" is defined generally as any knit structure formed on two needle beds and utilizing at least one needle from each bed. Utilizing two beds of a flat knitting machine to provide a double jersey knit structure may enhance the ability to include certain knit or non-knit features, particularly since utilizing two beds (instead of one) significantly increases the ability to selectively include visual designs, physical properties, and other features formed by a particular knitted structure, a particular yarn or combination of yarns, or a combination thereof. To illustrate, one yarn type (e.g., a thermoplastic polymer material yarn for forming a rigid fused area) may be located on an outer-facing surface, and a different yarn type (e.g., a polyester yarn) may be located on an opposite-facing surface (i.e., the inner surface) to provide comfort-related characteristics.

Still referring to FIG. 3, the first extension 142 may include a first edge 184, which may be located on its side closest to the forefoot portion 130. The first edge 184 may be a free edge when the knitted component 104 is initially removed from the knitting machine. Similarly, the second extension 144 may include a second edge 186. After the knitting process, the first edge 184 and/or the second edge 186 may be manipulated such that they are adjacent to a third edge 188 of the top layer 132 of the forefoot portion 130. Then, the first edge 184 and/or the second edge 186 may be secured to the third edge 188. The securement may be accomplished by any suitable means, such as by sewing, bonding via adhesive, etc. In some embodiments, this securement may occur when the knitted component 104 is located on a supporting foot-shaped last during a lasting process. One example of a lasting process is described in U.S. patent application Ser. No. 12/848,352, filed Aug. 2, 2010, and issued as U.S. Pat. No. 8,595,878, which is herein incorporated by reference in its entirety.

Once the securement is complete (or potentially before this securement), the knitted component 104 may be attached to other components of the article of footwear 100. For example, referring back to FIG. 2, the sole structure 106 may be attached to the bottom surface 162 of the bottom layer 134, and a midsole 190 may be placed within the void 118. If a midsole 190 is included, the midsole 190 may be within the void 118 and in contact with the top surface 160 of the bottom layer 134 during normal use, but it may be freely removable by a user. However, the midsole 190 may alternatively be secured to the top surface of the bottom layer 134 via any suitable device or method (e.g., sewing or adhesive bonding).

Figure 4:
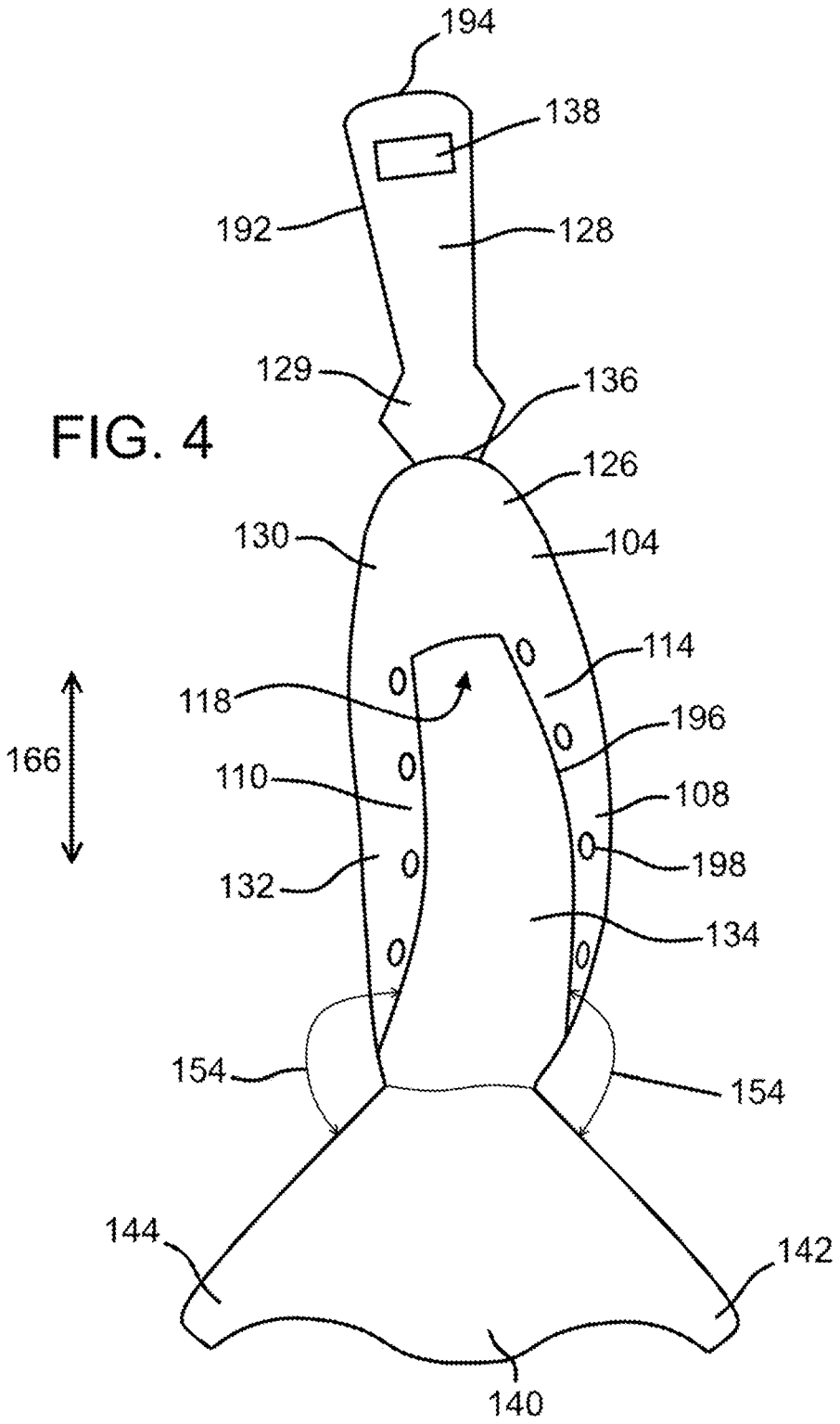
FIG. 4 is an illustration showing a knitted component for the article of footwear including a forefoot extension extending from a toe region in accordance with certain aspects of the present disclosure.

Referring to FIG. 4, in some embodiments, the knitted component 104 may include a forefoot extension 192 that extends from a toe area 126 of the forefoot portion 130. The forefoot extension 192 may share a common knit structure (e.g., a common course, loop, wale, and/or yarn) with the forefoot portion 130, and particularly at least one of the top layer 132 and the bottom layer 134. In some embodiments, the forefoot extension 192 may be secured to the forefoot portion 130 at the boundary 136 of the top layer 132 and the bottom layer 134. Advantageously, if the knitting direction is in the longitudinal direction 166, the forefoot extension 192 may be formed just before or after the formation of the forefoot portion 130 such that both needle beds of the knitting machine are focused on the forefoot extension 192. Thus, the formation of the forefoot extension 192 may utilize the full capacity of two needle beds of a knitting machine when formed, which may provide the ability for the forefoot extension 192 to have an enhanced complexity for providing certain physical and/or visual characteristics (e.g., a relatively strong, inelastic, and durable structure). The forefoot extension 192 may include a double-jersey knit structure, for example. Optionally, the forefoot extension 192 may include at least one pocket 138 (e.g., formed by two separable knit layers) for receiving other elements, such as a cushioning element (not shown). It is contemplated that the pocket 138 may have at least one inlaid floating yarn with relatively high softness to provide the cushioning. As one skilled in the art will understand, such an embodiments may be accomplished when two needle beds are available, which is an advantage provided by the layout of the knitted component 104.

As shown in FIG. 4, the forefoot extension may optionally be configured to form the tongue 128 of the article of footwear 100, and may additionally or alternatively include a toecap portion 129 for providing additional protection to the toes of a user. When the knitted component 104 is manipulated into its wearable shape, a forefoot portion 130 of the forefoot extension 192 may be pulled back (e.g., towards the heel portion 140) to form the upper end 194 of the tongue 128 (also shown in FIG. 1). As depicted in FIG. 1 (and as described in more detail below), the knitted component 104 may be inverted with respect to its orientation depicted in FIG. 4 when in its wearable orientation. Thus, referring to FIG. 4, the forefoot extension 192 forming the tongue 128 may be located at least partially outside the void 118 immediately after the knitting process, but within the void 118 between the top layer 132 and the bottom layer 134 when in its wearable orientation. Advantageously, the tongue 128 may provide additional protection to the top of the foot and, when a lacing system is used, may prevent laces from rubbing against the foot. A user may also pull on the tongue 128 putting on the article of footwear 100 to help ensure a proper fit. While the tongue 128 is described primarily herein as a portion of the knitted component 104, the tongue 128 may alternatively be formed separately and then secured to the knitted component 104 after the knitted component 104 is formed on the knitting machine.

When the knitted component 104 is inverted, the step of inverting the knitted component 104 may occur after the knitted component 104 is removed from the knitting machine, but before the first extension 142 and/or the second extension 144 are secured at the seam 154 (illustrated by arrows) to the top layer 132. Advantageously, the relatively amenable knitted component 104 (before forming the seam) may be more easily inverted and may be less susceptible to damage due to inversion. However, in other embodiments, the seam 154 may be formed prior to the inversion. This may be advantageous when the outer portion of the seam 154 ties or other remnants from its formation that are initially more easily isolated to the outside, but can be flipped inside so they are not wearable when the knitted component 104 is manipulated into its wearable state.

In some embodiments, and as depicted in the embodiment of FIG. 4, the top layer 132 of the forefoot portion 130 may include a throat opening 196 in the throat area 114. The throat opening 196 may be formed during the knitting process, or knitted material may be cut from the top layer 132 after the knitting process. One or more apertures 198 may be located on the respective lateral side 108 and medial side 110 of the throat opening 196 for receiving a fastening element, such as a shoelace. Advantageously, the throat opening 196 may enhance the ability of the top layer 132 to adjust around the foot (e.g., in response to pulling on a shoelace, for example).

The tongue 128, formed by the forefoot extension 192, may still remain to provide full protection to the top of the foot. Optionally, the tongue may be secured (e.g., via sewing) along its medial and lateral sides such that it remains in place when the article of footwear 100 is not worn, but this is not required. Further, in other embodiments (whether with a tongue or not), the throat opening may be absent, and the top layer 132 may substantially cover the top of the foot when worn.

Figure 5A:
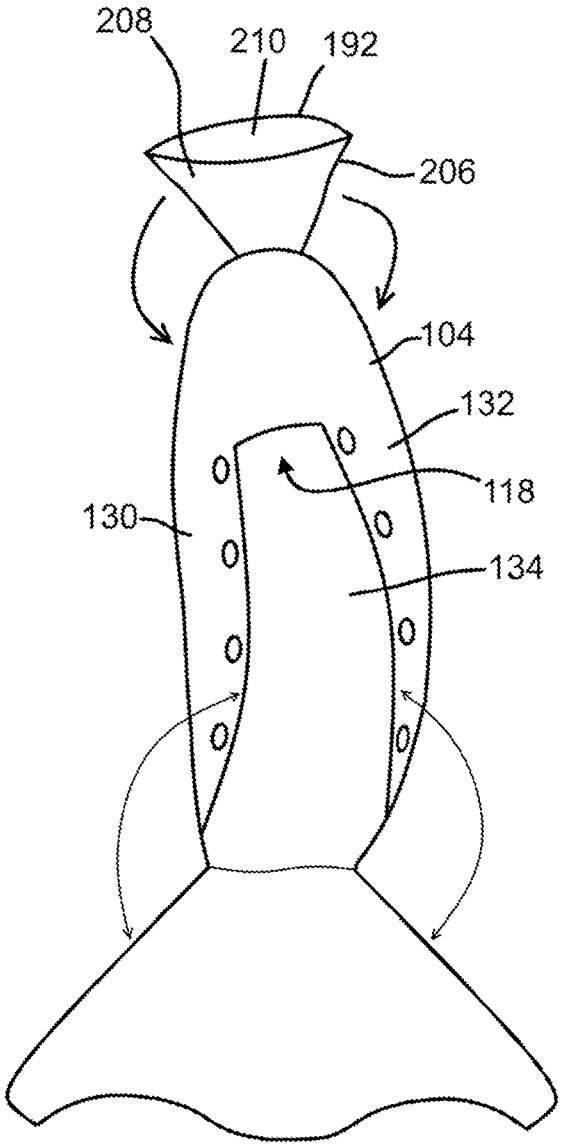
FIG. 5A is an illustration showing the article of footwear with a forefoot extension that forms toecap in accordance with certain aspects of the present disclosure.
Figure 5B:
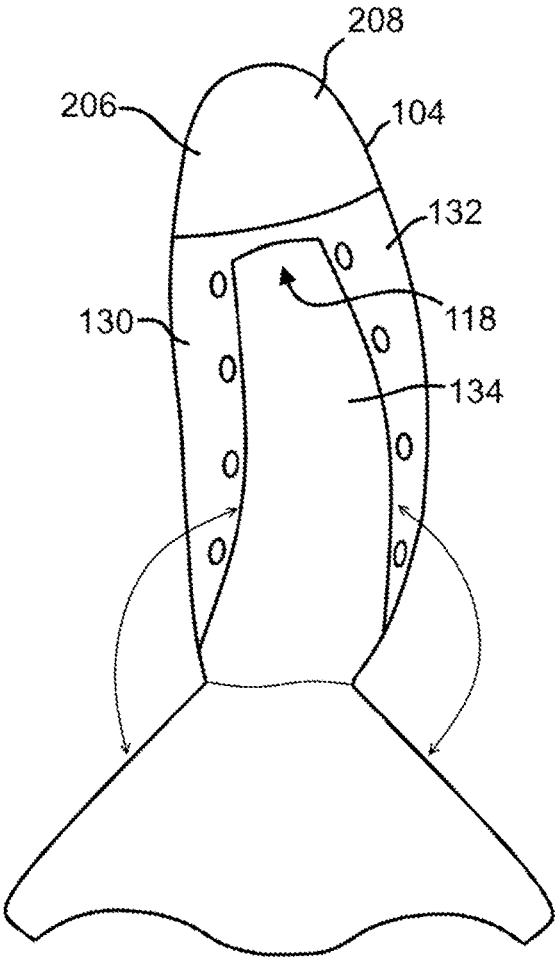
FIG. 5B is an illustration showing the embodiment of FIG. 5A when the toecap is inverted after a knitting process.

The forefoot extension 192 can additionally or alternatively form elements other than a tongue. For example, referring to FIG. 5A and FIG. 5B, the forefoot extension 192 may be a two-separable-layer knitted extension that forms a toecap 206, where the toecap 206 has an overfoot layer 208 and an underfoot layer 210. When the forefoot extension 192 includes separable layers (shown in FIG. 5A), the two layers may be formed using any suitable technique, such as any of the techniques described above with respect to knitting the top layer 132 and the bottom layer 134 of the forefoot portion 130. After the knitting process and referring to FIG. 5B, the toecap 206 may be inverted with respect to its orientation in FIG. 5A such that the overfoot layer 208 covers, and is coextensive with, the toe area of the top layer 132, and such that the underfoot layer 210 covers, and is coextensive with, the toe area of the bottom layer 134. The toecap 206 may then be secured to the top layer 132 and/or the bottom layer 134 using any suitable device or method (e.g., a sewn seam, an adhesive, by heat-treating thermoplastic polymer yarns to fuse the two elements together, etc.). Advantageously, the toecap 206 may provide an additional knitted structure for protecting the toe of a wearer and/or providing other desirable functions related to additional knitted layers. Optionally, the knitted component 104 may be inverted (as described in more detail above) such that the toecap 206 is moved to within the void 118 between the top layer 132 and the bottom layer 134. In other embodiments, the toecap 206 may remain outside the void 118.

Figure 6:
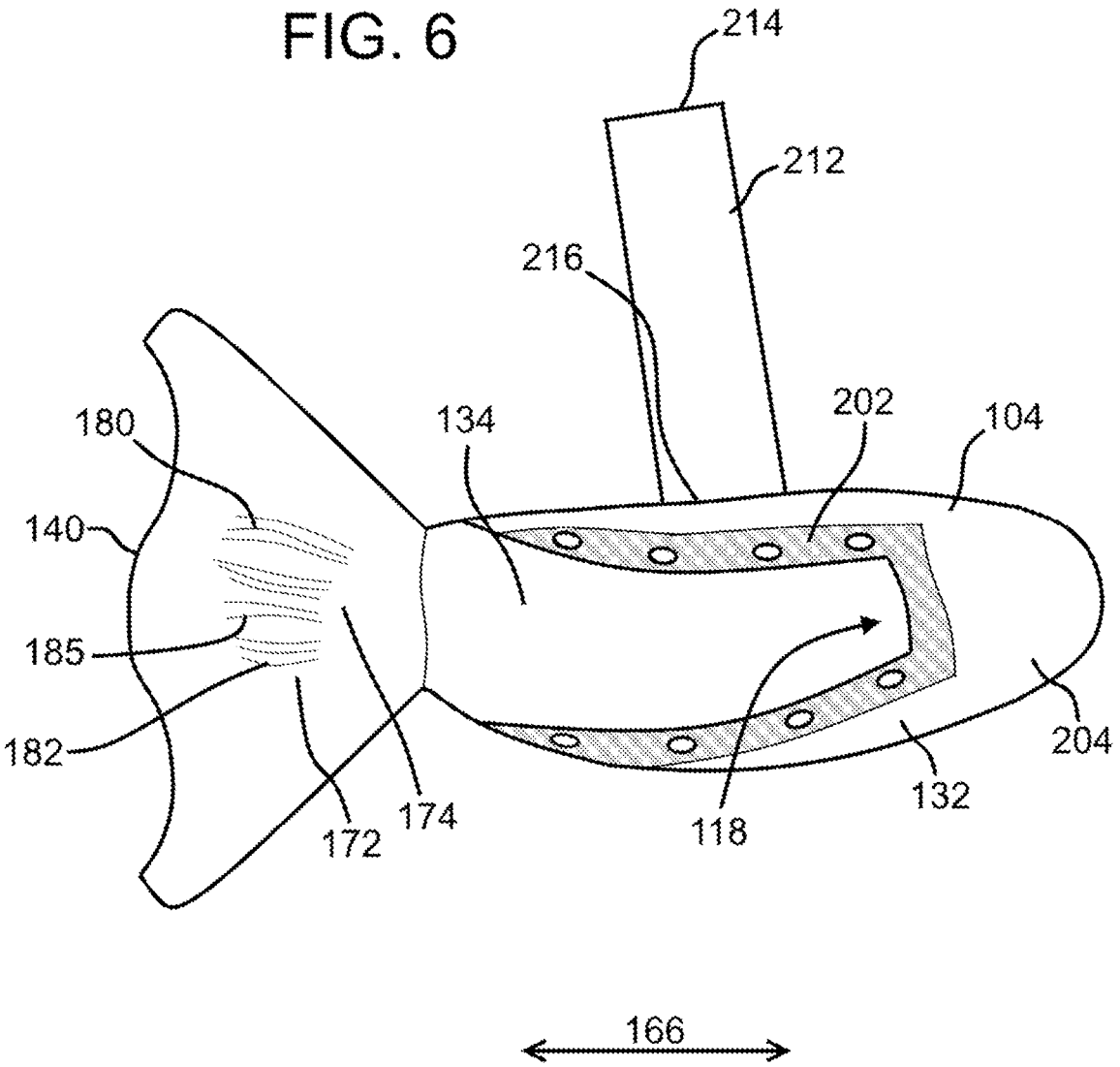
FIG. 6 is an illustration showing the article of footwear with a side extension in accordance with certain aspects of the present disclosure.

FIG. 6 is an illustration showing the knitted component 104 with a side extension 212. Like the forefoot extension described above, the side extension 212 may extend from the boundary where the top layer 132 and the bottom layer 134 meet. Thus, when knitting in the longitudinal direction 166, the side extension 212 will extend beyond the needles that are used to form the top layer 132 and the bottom layer 134 on the needle bed, and therefore the side extension 212 may be formed with the full capacity of both needle beds, which is associated with the advantages described above. As shown, the side extension 212 may be in the form of a strap 214. The strap 214 may be configured to wrap around the foot of a wearer to provide tightening (e.g., in lieu of laces) and/or for additional medial-to-lateral support. When the knitted component 104 is inverted, the side extension 212 may move from outside the void 118 to inside the void 118 (or vice versa). Thus, the strap 214 may be within the void when the knitted component 104 is in its wearable state. It is also contemplated that the side extension 212 may be formed as a tubular structure with components inserted therein. When formed as a tubular structure, it is further contemplated that the strap may be pulled from outside the void 118 to within the void 118 through its end 216 while inverting the side extension 212 with respect to itself.

Advantageously, the strap 214 may therefore be knitted outside the void 118, pulled to within the void 118, and then again moved out of the void 118 when the top layer 132 and the bottom layer 134 are inverted during post-knit processing.

As described above, the knitted component 104 may have zonal properties. For example, in one non-limiting exemplary embodiment, the top layer 132 of the forefoot portion may have a first zone 202 in the throat area 114 and a second zone 204 adjacent to the first zone 202. The first zone 202 and the second zone 204 may have different knit structures such that, when subjected to the same stretching force, the first zone 202 stretches less than the amount the second zone 204 stretches. The differences in elasticity can be tested by applying an equal tension force on both zones and then measuring the displacement (per unit of initial length). For example, the first zone 202 may have a knit structure that has a higher gauge than the second zone 204 such that it has a higher stitch density (i.e., knitted loops per unit area), which may provide a lower elasticity.

Additionally or alternatively, the first zone 202 may be formed of yarns with different materials, or may be treated differently during post-knit processing, to provide the first zone with lower elasticity. For example, the first zone 202 may include a thermoplastic polymer material with a relatively low melting point that melts when heat is applied and then cools into a fused state when cooled, thus forming a relatively rigid structure. The thermoplastic polymer material in the first zone 202 may be the same thermoplastic polymer material described above with respect to the "fusible yarn," but optionally it may be a different thermoplastic polymer material provided by a separate yarn and with a different (e.g., higher) melting point (and the fusible yarns are not necessary excluded from the first zone 202 or the second zone 204 in this embodiment). For example, in one non-limiting exemplary embodiment, both the first zone 202 and the second zone 204 include the above-described fusible yarns. The first zone 202 may additionally include an amount of a second thermoplastic polymer, which may be a thermoplastic polyurethane with a melting point of between about 80° C. and about 200° C., such as from about 100° C. to about 125° C. based on atmospheric pressure at sea level. This second thermoplastic polymer material may provide a relatively high rigidity after heat processing. Any suitable amount of the second thermoplastic polymer material may be included. While zonal properties are primarily described with respect to the depicted zones 202, 204 of the top layer 132, other areas of the knitted component 104 may additionally or alternatively include different zones with different physical and/or visual properties.

Another advantage of forming the heel portion 140 on two needle beds (as described above) is the ability to provide the heel portion 140 with a natural tendency to curve due to a specific knit structure. For example, the heel portion 140 of the knitted component 104 may include a medial heel side 170, a lateral heel side 172, and a rear portion 174 between the medial heel side 170 and the lateral heel side 172, where at least one of the medial heel side 170 and the lateral heel side 172 includes a convex area on the inner surface 176 of the knitted component 104. For example, as shown, the medial heel side 170 includes a first convex area 180 on the inner surface 178 and the lateral heel side 172 includes a second convex area 182 on the inner surface 178. Oppositely, with respect to the outer surface (which is hidden in FIG. 6), the medial heel side 170 and the lateral heel side 172 each include a concave area. Thus, the medial heel side 170 and the lateral heel side 172 may at least partially surround the achilles tendon of a wearer, which may enhance the fit of the article of footwear 100 for providing more support, less slippage, and overall better footwear performance. The rear portion 174 may include a concave area 185 on the inner surface 178 and convex on the outer surface, which matches the natural profile of the achilles tendon on the heel of a typical wearer.

The tendency to curve may be formed using any suitable knitting process. For example, in one embodiment, and referring to the medial heel side 170 and the lateral heel side 172 (and opposite the rear portion 174), more tension may be included on the outer surface than on the inner surface 178 of the heel portion 140 during the knitting process. This may be the result of more loops being formed on the inner surface 178 than the outer surface (e.g., in a two-bed knit structure), by varying the tension in the respective yarns/loops with tension-effecting components of the knitting machine, by using yarns having different elasticities and/or deniers, etc. Specific examples of methods of forming a knit structure with a natural tendency to curve are included in U.S. patent application Ser. No. 15/454,034, filed Mar. 9, 2017, which is herein incorporated by reference in its entirety. Further, the tendency to curve may be amplified through certain post-processing steps such as steaming, which may for example, tighten the yarns of the knitted component 104, which may enhance the effect of a disparity between the amounts of tension on respective surfaces of the knitted component 104.

All of the structures and methods disclosed and claimed herein can be made and executed without undue experimentation in light of the present disclosure. While this disclosure may be embodied in many different forms, there are described in detail herein specific aspects of the disclosure. The present disclosure is an exemplification of the principles of the disclosure and is not intended to limit the disclosure to the particular aspects illustrated. In addition, unless expressly stated to the contrary, use of the term "a" is intended to include "at least one" or "one or more." For example, "a yarn" is intended to include "at least one yarn" or "one or more yarns."

Any ranges given either in absolute terms or in approximate terms are intended to encompass both, and any definitions used herein are intended to be clarifying and not limiting. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the disclosure and without diminishing its intended advantages. It is therefore intended that such changes and modifications be covered by the appended claims.

What is claimed is:

1. A method, comprising:

forming a forefoot portion of a knitted component on a knitting machine, the forefoot portion having a top layer and a bottom layer, wherein a void is formed between the top layer and the bottom layer, and wherein the top layer is secured to the bottom layer via at least one common knit structure;

forming a heel portion of the knitted component on the knitting machine, wherein the heel portion is secured to the bottom layer of the forefoot portion via at least one common knit structure, wherein the heel portion comprises a medial heel side, a lateral heel side, and a rear portion between the medial heel side and the lateral heel side, wherein at least one of the medial heel side, the lateral heel side, and the rear portion comprises a convex area on an inner surface of the heel portion; and forming at least one extension of the knitted component on the knitting machine, the at least one extension being attached to the heel portion.

2. The method of claim 1, wherein the at least one extension includes a first edge configured for securing to a second edge of the top layer of the forefoot portion.

3. The method of claim 1, wherein a first extension and a second extension each extend from the heel portion and are configured for securing to at least one edge of the top layer of the forefoot portion, wherein the first extension extends in a lateral direction from the heel portion, and wherein the second extension extends in a medial direction from the heel portion.

4. The method of claim 1, wherein the heel portion comprises a knit structure that has a greater density than respective knit structures of the top layer and the bottom layer of the forefoot portion.

5. The method of claim 1, further comprising forming a knitted forefoot extension on the knitting machine, the knitted forefoot extension extending from a boundary located between the top layer and the bottom layer of the forefoot portion.

6. The method of claim 5, wherein the knitted forefoot extension comprises multiple separable layers.

7. The method of claim 5, wherein the knitted forefoot extension is at least partially coextensive with the top layer and the bottom layer.

8. The method of claim 1, wherein the knitted component comprises a side extension extending from a boundary between the top layer and the bottom layer of the forefoot portion.

9. The method of claim 8, wherein the side extension forms a strap for surrounding a foot of a wearer when incorporated into an article of footwear.

10. A method of manufacturing an upper for an article of footwear, the method comprising:

forming a forefoot portion on a knitting machine, the forefoot portion having a top layer and a bottom layer, and a void formed between the top layer and the bottom layer; and forming a heel portion on the knitting machine, the heel portion being secured to the bottom layer of the forefoot portion and indirectly secured to the top layer through the bottom layer of the forefoot portion, the heel portion forming a first portion of a collar, wherein the heel portion comprises a medial heel side, a lateral heel side, and a rear portion between the medial heel side and the lateral heel side, wherein at least one of the medial heel side, the lateral heel side, and the rear portion comprises a convex area on an inner surface of the heel portion.

11. The method of claim 10, wherein the top layer is secured to the bottom layer via at least one common knit structure.

12. The method of claim 11, further comprising a side extension extending from a boundary located between the top layer and the bottom layer of the forefoot portion.

13. The method of claim 10, wherein the heel portion is secured to the bottom layer of the forefoot portion via a common knit structure.

14. The method of claim 10, further comprising forming a side extension on the knitting machine, the side extension extending from a boundary located between the top layer and the bottom layer of the forefoot portion.

15. The method of claim 14, wherein the side extension forms a strap for surrounding a foot of a wearer when incorporated into the article of footwear.

16. The method of claim 10, further comprising forming a knitted forefoot extension on the knitting machine, the knitted forefoot extension extending from a boundary between the top layer and the bottom layer of the forefoot portion.

17. The method of claim 16, wherein the knitted forefoot extension is a two-layer knitted extension.

18. A method of manufacturing an article of footwear, the method comprising:

forming a forefoot portion of an upper on a knitting machine, the forefoot portion having a top layer and a bottom layer;

forming a heel portion of the upper on the knitting machine, the heel portion secured to the bottom layer of the forefoot portion and indirectly secured to the top layer through the bottom layer of the forefoot portion, the heel portion forming a portion of a collar of the upper, wherein the heel portion comprises a medial heel side, a lateral heel side, and a rear portion between the medial heel side and the lateral heel side, wherein at least one of the medial heel side, the lateral heel side, and the rear portion comprises a convex area on an inner surface of the heel portion; and attaching the upper to a sole structured.

* * * * *